United States Patent [19]

Happel

[11] 4,224,906

[45] Sep. 30, 1980

[54] COMBUSTION ENGINE WITH INTERNAL COMBUSTION

[75] Inventor: Robert Happel, Waiblingen-Bittenfeld, Fed. Rep. of Germany

[73] Assignee: Daimler-Benz Aktiengesellschaft, Fed. Rep. of Germany

[21] Appl. No.: 882,910

[22] Filed: Mar. 2, 1978

[30] Foreign Application Priority Data

Mar. 9, 1977 [DE] Fed. Rep. of Germany ..... 2710189

[51] Int. Cl.[3] ..... F01L 9/02; F02M 25/06

[52] U.S. Cl. ..... 123/90.15; 123/90.16; 123/568

[58] Field of Search ..... 123/90.15, 90.16, 119 A

[56] References Cited

U.S. PATENT DOCUMENTS

| | | | |
|---|---|---|---|
| 3,641,988 | 2/1972 | Torazza et al. | 123/90.16 |
| 3,714,932 | 2/1973 | Meacham et al. | 123/90.15 |
| 4,134,371 | 1/1979 | Hausknecht | 123/90.16 |

*Primary Examiner*—Wendell E. Burns

*Attorney, Agent, or Firm*—Craig & Antonelli

[57] ABSTRACT

A combustion engine with internal combustion, exhaust gas return and inlet and exhaust systems separate as regards their gas paths, in which the exhaust gas return system is essentially independent in its gas paths from the inlet system.

33 Claims, 2 Drawing Figures

COMBUSTION ENGINE WITH INTERNAL COMBUSTION

Figure 1:
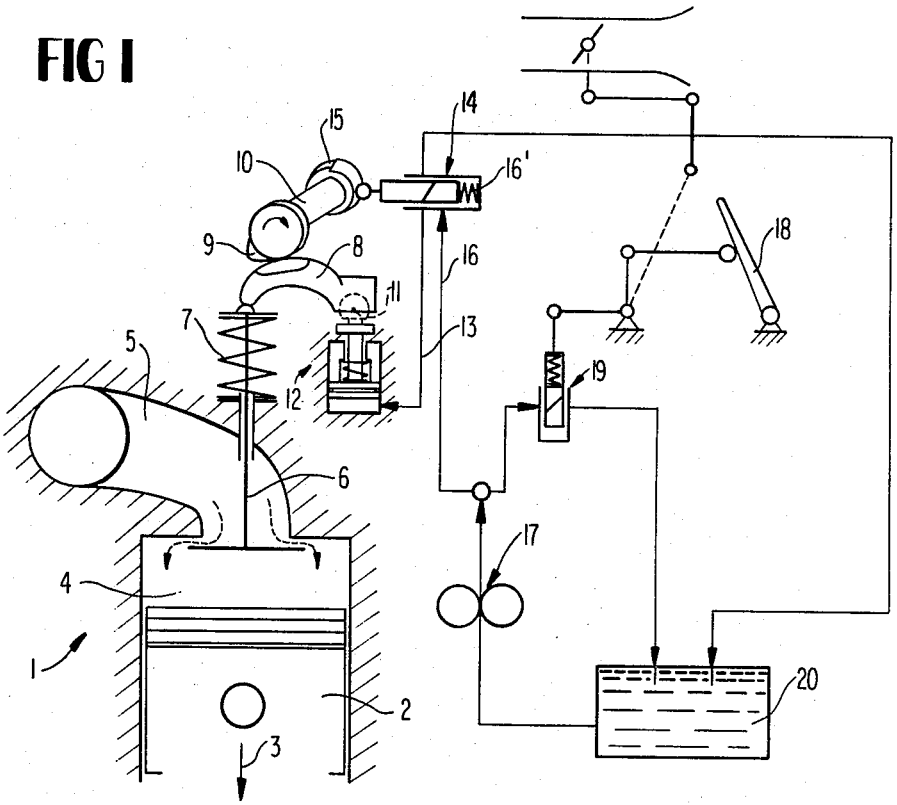

The present invention relates to a combustion engine with internal combustion, exhaust gas return and separate inlet and exhaust systems as regards their gas paths.

With known engines of this type, the exhaust gas return takes place customarily by way of a cross connection between an exhaust channel and an inlet channel, whereby the cross connection is controllable. The returned exhaust gas then enters, together with the fresh gas, into the combustion space of the engine by way of the inlet channel. Contaminations of the exhaust gas lead with such systems, especially in conjunction with precipitating fuel particles, to deposits in the inlet channel and at the respective gas-exchange control element coordinated to the inlet channel with the effect that the free inlet cross sections are reduced and the filling degree of the engine is deteriorated. The heating of the inlet system achieved by the returned exhaust gases is also effective in this direction.

A system for the exhaust gas return in internal combustion engines is to be provided by the present invention which avoids the aforementioned disadvantages.

This is achieved according to the present invention in that the internal combustion engine with a construction according to the present invention is equipped with an exhaust gas return system independent from the inlet system as regards the gas paths. This can be achieved, on the one hand, in that a separate exhaust gas return system is provided which is independent from the inlet and exhaust system. A particularly advantageous solution according to the present invention which leads to an altogether particularly simple engine construction, resides in that an exhaust gas return system is provided which is coordinated to the exhaust system of the engine. This is thereby appropriately integrated into the exhaust system, whereby a preferred solution characterized by particularly great simplicity resides in controlling the gas return from the exhaust channel by way of the exhaust control element. An additional control can thereby be coordinated to the exhaust control element, by way of which the exhaust control element is controllable with respect to the exhaust gas return superimposed on the exhaust control.

The return of the exhaust gases thereby takes place preferably in the early suction stroke whereby the closing point of the exhaust control element is correspondingly adjustable.

A simple possibility for the shifting of the closing point of the gas-exchange exhaust-control element consists with a valve as control element, in adjusting the support height of the bearing support of the valve which can take place within the scope of the present invention preferably hydraulically. A closure element actuatable by way of the cam shaft of the internal combustion engine is thereby appropriately interconnected in the feed of the hydraulic bearing support adjustment, by way of which the pressure medium supply to the bearing support can take place in fixed coordination to the valve-actuating cam.

Furthermore, the pressure medium supply can be additionally controlled according to the present invention as a function of engine rotational speed and/or load, for which purposes a control member operating in dependence on the rotational speed and/or in dependence on the load is arranged in the supply path.

Accordingly, it is an object of the present invention to provide an internal combustion engine of the aforementioned type which avoids by simple means the aforedescribed shortcomings and drawbacks encountered in the prior art.

Another object of the present invention resides in a combustion engine with internal combustion in which the danger of a reduction of the free inlet cross section and a deterioration of the filling degree of the engine are effectively prevented.

A further object of the present invention resides in an internal combustion engine of the type described above which is characterized by a particularly simple construction utilizing relatively few parts that can be easily installed and adjusted.

Still a further object of the present invention resides in a combustion engine with internal combustion, exhaust gas return and inlet and exhaust systems separate as regards their gas paths, which excels by its great simplicity and reliability in operation.

Still another object of the present invention resides in a control system for the control of the exhaust gas return in internal combustion engines which is both simple, easily controllable and highly reliable in its operation.

Figure 2:
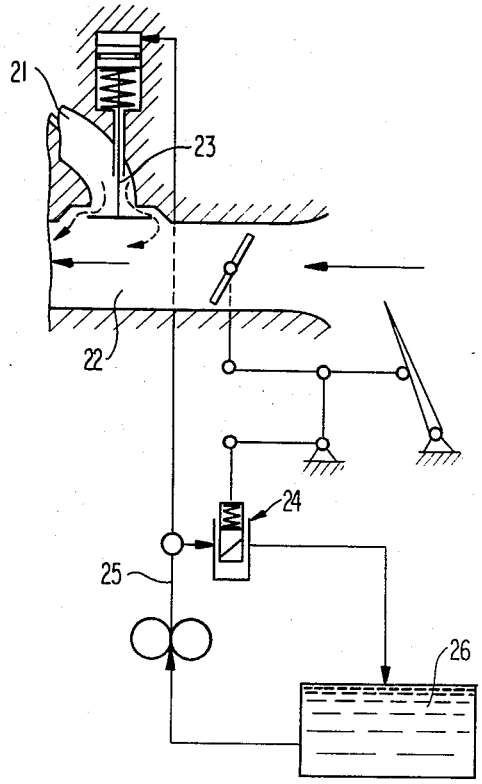

These and other objects, features and advantages of the present invention will become more apparent from the following description when taken in connection with the accompanying drawing which shows, for purposes of illustration only, two embodiments in accordance with the present invention, and wherein:

FIG. 1 is a schematic view of an internal combustion engine operating with an exhaust gas return system according to the present invention; and FIG. 2 is a schematic view of a further possibility for the actuation of the valve controlling the exhaust gas return system according to the present invention.

Referring now to the drawing wherein like reference numerals are used throughout the two views to designate like parts, and more particularly to FIG. 1, the cylinder generally designated by reference numeral 1 of a reciprocating piston internal combustion engine is illustrated in the schematic showing thereof in cross section, in which a piston 2 is arranged that is just in the suction or intake phase thereof as indicated by the arrow 3.

The exhaust channel 5 adjoins the combustion space 4 of the four-stroke reciprocating internal combustion engine referred to in the illustrated embodiment which combustion space is limited partly by the piston 2 and has a variable volume. A valve 6 is provided as gas-exchange control element in the transition from the exhaust channel 5 to the combustion space 4. A rocker arm 8 is coordinated to the valve 6 for the actuation thereof, which is spring-loaded in the customary manner in the direction towards its closing position by way of a valve spring 7; the rocker arm 8 is adapted to be actuated by way of the cam 9 of the cam shaft and is supported on a joint ball 11 which is coordinated to the bearing support 12 and is hydraulically adjustable in its height.

The pressure medium feed and discharge thereby takes place by way of a line 13 to which is coordinated a closure member 14 that is controllable with a slide-valve-like construction by way of a cam disk 15 coordinated to the cam shaft 10 so that the closure member 14 is controllingly actuated within a range fixed with respect to the actuating cam 9. The cam disk 15 is undercut for this purpose in the illustrated embodiment over an angular range of about 150° so that the slide valve member provided as the closure element member 14 is displaced into its opening position by way of the spring 16' stressing the same against the cam disk 15, whereby the line 13 is connected by way of the closure member 14 and the line 16 with a pressure medium circulatory system, which is symbolically represented therein by the pump generally designated by the reference numeral 17 and which may be formed by the lubricant circulatory system of the engine. An opening range of up to 300° crankshaft results for the valve 6 corresponding to the provided undercut range of up to 150° cam shaft, whereby the exhaust opens preferably within the range of about 60° prior to the lower dead-center position UT in the expansion stroke and at the latest in the early suction stroke, that is, closes at approximately 60° after the upper dead-center position OT during the suction stroke.

A load-dependent control may be superimposed on the control on the bearing support 12 for the pressure medium supply and height adjustment of the support of the rocker arm 8 by way of the closure member 14, as shown in FIG. 1, in such a manner that at least in the higher load range the pressure medium supply for the height adjustment of the bearing support point of the rocker arm 8 is by-passed with respect to the reservoir tank 20 by way of a further closure element 19 coupled with the drive pedal 18.

The control according to the present invention, in which at least within the lower load range the exhaust valve 6 is kept open beyond the exhaust stroke into the suction stroke, so that exhaust gas can be sucked back out of the exhaust channel 5, provides an exhaust gas return without impairment of the intake system. Separate exhaust gas return channels are also avoided in particular. In the higher load and/or rotational speed range, the exhaust gas return can be interrupted in a simple manner by a control of the type according to the present invention. By reason of the fact that the pump 17 is dependent in its rotational speed on the rotational speed of the internal combustion engine and fluctuates synchronously with respect thereto in its feed pressure, respectively, in its feed quantity, in the solution according to the present invention the support height of the bearing support and therewith the stroke height of the valve 6 as well as the opening period will adjust itself also in dependence on the rotational speed of the engine.

A load- or rotational-speed-dependent control of the exhaust gas return valve as described hereinabove is also possible independently of the exhaust gas return system described by reference to FIG. 1 in by-passing of the inlet system, where an exhaust gas return channel 21 terminates onto an inlet channel 22 (FIG. 2) and where the exhaust gas return channel 21 is controllable by a valve 23 which is actuated by a pressure medium. The valve 23 is kept opened by the illustrated connection thereof to a pressure medium circulatory system for such length of time until a closure member 24 opens up dependent on load and/or rotational speed a cross connection between the pressure medium supply line 25 to the valve 23 and the supply tank 26. With such an arrangement, the exhaust gas return channel 21 is connected with the inlet channel 22 by way of the valve 23, as this is possible by reason of the discharge onto the inlet channel 22, until at higher load and/or higher rotational speed the pressure medium supply to the valve 23 is interrupted by the opening of the closure member 24 and therewith the exhaust gas return channel 21 is closingly controlled with respect to the inlet channel 22. The magnitude of the opening stroke of the valve 23 is thereby dependent on the magnitude of the working pressure of the pressure medium and therewith on the engine rotational speed—with a pump coupled to the internal combustion engine and operating correspondingly in dependence on the rotational speed—which is desirable. In a similar manner this is also the case—as already indicated with respect to FIG. 1—with a control of the valve by means of the pressure medium branched out of the lubricating circulatory system of the engine.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An internal combustion engine, the internal combustion engine including an exhaust gas return means and separate inlet and exhaust means separate as regards the gas paths thereof, characterized in that the exhaust gas return means is essentially independent in the gas paths thereof from the inlet means.

2. An internal combustion engine according to claim 1, characterized in that the exhaust gas return means is coordinated to the exhaust means.

3. An internal combustion engine according to claim 2, characterized in that the exhaust gas return means is integrated into the exhaust means.

4. An internal combustion engine according to claim 2, characterized in that the exhaust means and the exhaust gas return means are provided with common gas-exchange control elements.

5. An internal combustion engine according to claim 4, characterized in that said common gas-exchange control element includes common valve means.

6. An internal combustion engine according to claim 4, characterized in that the exhaust means includes an exhaust gas channel means, and in that the exhaust-gas-exchange control element controls the exhaust gas return means by enabling a return of exhaust gas out of the exhaust gas channel means.

7. An internal combustion engine according to claim 6, characterized in that means are provided for changing the control time for the exhaust-gas-exchange control element in dependence on a load of the engine.

8. An internal combustion engine according to claim 7, characterized in that exhaust gases are returned out of the exhaust gas channel means during an early suction stroke of the engine.

9. An internal combustion engine according to claim 8, characterized in that the exhaust gas exchange control element is closed at the latest within the range of a suction stroke.

10. An internal combustion engine according to claim 9, characterized in that the exhaust gas exchange control element is closed within a range of an early suction stroke.

11. An internal combustion engine according to claim 9, characterized in that means are provided for enabling an adjustment of a closing point of the exhaust gas exchange control element.

12. An internal combustion engine according to claim 11, characterized in that the adjustment enabling means includes means for adjusting a support height of a bearing support means of a rocker arm actuating the exhaust-gas-exchange control element.

13. An internal combustion engine according to claim 12, characterized in that the means for adjusting the support height of the bearing support means includes a hydraulic bearing support means.

14. An internal combustion engine according to claim 13, characterized in that a closure means actuatable by way of a cam shaft of the internal combustion engine is arranged in a feed path for the hydraulic bearing support means, the closure means is controllable in fixed coordination to an actuating cam of the rocker arm so as to control a pressure medium supply to the bearing support means.

15. An internal combustion engine according to claim 14, characterized in that a pressure of the hydraulic pressure medium is dependent on the engine rotational speed.

16. An internal combustion engine according to claim 15, characterized in that a supply of the pressure medium for the adjustment of the bearing support means is controllable in dependence on a load of the engine.

17. An internal combustion engine according to claim 16, characterized in that a supply of the pressure medium for the adjustment of the bearing support means is controllable in dependence on the rotational speed of the engine.

18. An internal combustion engine according to claim 17, characterized in that a control device operating in dependence on a load of the engine is arranged in a supply path of the pressure medium, the control device is series-connected upstream to the closure means actuatable by way of the cam shaft.

19. An internal combustion engine according to claim 18, characterized in that the control device is operatively connected with a drive pedal.

20. An internal combustion engine according to claim 1, with an element controlling the exhaust gas return means, characterized in that a means is provided for changing a control time for the element controlling the exhaust gas return means in dependence on a load of the engine.

21. An internal combustion engine according to claim 1, characterized in that a return of the exhaust gases is carried out during an early suction stroke of the engine.

22. An internal combustion engine according to claim 21, with an exhaust gas exchange control element, characterized in that the exhaust gas exchange control element is closed at the latest within a range of the suction stroke.

23. An internal combustion engine according to claim 22, characterized in that the exhaust gas-exchange control element is closed within a range of the early suction stroke.

24. An internal combustion engine according to claim 22, characterized in that means are provided for enabling an adjustment of a closing point of the exhaust gas exchange control element.

25. An internal combustion engine according to claim 1, characterized in that the adjustment enabling means includes means for adjusting a support height of a bearing support means of a rocker arm actuating the exhaust-gas-exchange control element.

26. An internal combustion engine according to claim 25, characterized in that the means for adjusting the support height of the bearing support means includes a hydraulic bearing support means.

27. An internal combustion engine according to claim 25, characterized in that a closure means actuatable by way of a cam shaft of the internal combustion engine is arranged in a feed path for the hydraulic bearing support means, the closure means is controllable in fixed coordination to an actuating cam of the rocker arm so as to control a pressure medium supply to the bearing support means.

28. An internal combustion engine according to claim 26, characterized in that a pressure of the hydraulic pressure medium is dependent on the engine rotational speed.

29. An internal combustion engine according to claim 26, characterized in that a supply of the pressure medium for the adjustment of the bearing support means is controllable in dependence on a load of the engine.

30. An internal combustion engine according to claim 26, characterized in that a supply of the pressure medium for the adjustment of the bearing support means is controllable in dependance on the rotational speed of the engine.

31. An internal combustion engine according to claim 29, characterized in that a control device operating in dependence on a load of the engine is arranged in a supply path of the pressure medium, the control device is series-connected upstream to the closure means actuatable by way of the cam shaft.

32. An internal combustion engine according to claim 31, characterized in that the control device is operatively connected with a drive pedal.

33. A combustion engine with internal combustion within combustion chamber means, comprising inlet means, exhaust means separate from the inlet means as regards the gas paths thereof and exhaust gas return means for returning at least a portion of the exhaust gases to the combustion chamber means, characterized in that the exhaust gas return means is essentially independent in gas paths thereof from the inlet means, and in that control means are provided for adjustably controlling a control timing of the exhaust gas return means as a function of at least one of the two control magnitudes consisting of load and rotational speed.

* * * * *